US006030093A

United States Patent [19]

Draper

[11] Patent Number: 6,030,093

[45] Date of Patent: Feb. 29, 2000

[54] MULTIPLE CANDLE LANTERN

[76] Inventor: Gregory L. Draper, 9225-151st Ave. NE., Redmond, Wash. 98052

[21] Appl. No.: 09/153,670

[22] Filed: Sep. 15, 1998

[51] Int. Cl.[7] ..... F21L 19/00

[52] U.S. Cl. ..... 362/161; 362/172; 362/181; 431/295

[58] Field of Search ..... 362/161, 162, 362/163, 171, 172, 178, 179, 180, 181, 184, 266, 288, 312–316; 431/291, 295, 297

[56] References Cited

U.S. PATENT DOCUMENTS

| | | | |
|---|---|---|---|
| 343,461 | 6/1886 | Kuntz | 362/163 |
| 3,091,106 | 5/1963 | Crouch | 431/295 |
| 3,867,625 | 2/1975 | Whalen | 362/161 |
| 4,186,430 | 1/1980 | Britton | 362/162 |
| 4,260,365 | 4/1981 | Kayne | 431/291 |
| 4,566,055 | 1/1986 | Klees et al. | 362/162 |
| 5,424,928 | 6/1995 | Jordan et al. | 362/162 |
| 5,688,040 | 11/1997 | Klees | 362/163 |
| 5,722,763 | 3/1998 | Chen | 362/163 |

FOREIGN PATENT DOCUMENTS

| | | | |
|---|---|---|---|
| 60645 | 5/1912 | Switzerland | 362/161 |

*Primary Examiner*—Alan Cariaso
*Attorney, Agent, or Firm*—Dean A. Craine

[57] ABSTRACT

A multiple candle lantern designed to be used with a plurality of tube candles. The candle lantern includes an upper cover that selectively attaches to a lower base and a heat shield disposed over the top opening of the upper cover. The lower base has a plurality of tube candle recessed spaces formed thereon which hold a tube candle in a longitudinally aligned position thereon. Each tube candle includes a candle longitudinally aligned inside a metal outer tube. A spring is disposed between the lower base and the candle which keeps the candle's wick extending from the upper hole formed on the tube as the candle burns. Formed on the sides of the upper cover near the lower edge are a plurality of air delivery slots which deliver ventilation air directly into the candle lantern and against the sides of the tube candles.

10 Claims, 2 Drawing Sheets

MULTIPLE CANDLE LANTERN

BACKGROUND OF THE INVENTION

1. Field of the Invention

This invention relates to candle-type illumination devices and, more particularly, to portable candle lanterns.

2. Description of the Related Art

Typical portable candle lanterns use one candle housed inside a relatively small, candle holder assembly. Such candle lanterns are described in U.S. Pat. Nos. 5,688,040, 4,566,065, 4,260,365, 4,186,430, and 3,867,625.

One drawback with such candle lanterns is that they produce relatively small amounts of illumination and heat. Methods used to increase illumination and heat production include increasing the size of the candle, increasing the total number of candles, and increasing the size of the viewing windows in the candle lantern.

One drawback with multiple candle lanterns is securely attaching each candle inside the lantern during use. Another drawback is keeping the candles' wicks at a constant, optimal position behind the viewing windows as the candles burn. A third drawback is providing adequate ventilation air to support combustion of multiple candles.

SUMMARY OF THE INVENTION

It is an object of the invention to provide an improved candle lantern which uses multiple candles for greater illumination.

It is another object of the invention to provide such a candle lantern with a heat shield that can be used for heating or cooking.

It is a further object of the invention to provide such a candle lantern in which the candles are securely attached inside the candle lantern, and have their wicks maintained at a constant, optimal position behind the lens.

It is a still further object of the invention to provide such a candle lantern designed to provide adequate ventilation air to support combustion of multiple candles.

These and other objects of the invention are met by providing a multiple candle lantern designed to be used with a plurality of tube candles. The candle lantern includes an upper cover that selectively attaches to a wide lower base. The lower base has means for securely and removably holding a plurality of tubes candle in a stationary, longitudinally aligned position inside the candle lantern. Each tube candle includes an outer tube in which a short, cylindrical candle is placed. A biasing means is disposed between the lower base and the candle which forces the candle upward inside the outer tube. Each outer tube has an upper opening through which the candle's wick extends. The length of the outer tube is sufficient so that the upper opening and, hence the wick, are disposed behind the viewing windows. During use, the biasing means keeps the candle positioned inside the outer tube so that the wick constantly extends and burns through the outer tube's upper opening. In the preferred embodiment, there are three radially aligned tube candles disposed inside the candle lantern.

Disposed over the top opening of the upper cover is a heat shield. The heat shield is designed to act a wide, heat-conducting surface for heating small volumes of liquids or other items when placed thereon. The heat shield is positioned a sufficient distance above the tube candles to provide adequate air flow through the candle lantern and to prevent overheating, and to minimize the amount of heat conducted to the sides of the upper cover.

Formed on the sides of the upper cover near it's lower edge are relatively large, radially aligned air delivery slots. The air delivery slots are designed to evenly deliver outside ventilation air into the candle lantern to support combustion of the candles. During use, a venturi effect is created near the heat shield as the heated air travels through the upper exhaust openings which increase the flow of ventilation air into the candle lantern to support combustion. Also formed on the lower base is a collection cavity which is used to collect melted, hot wax from the tube candles during use.

The lantern's upper cover and lens are designed for easy attachment and removal from the lower base so that the tube candles may be easily replaced and lighted. A handle is also provided to allow the candle lantern to be hung or easily transported.

DESCRIPTION OF THE PREFERRED EMBODIMENT(S)

Figures 1, 2:
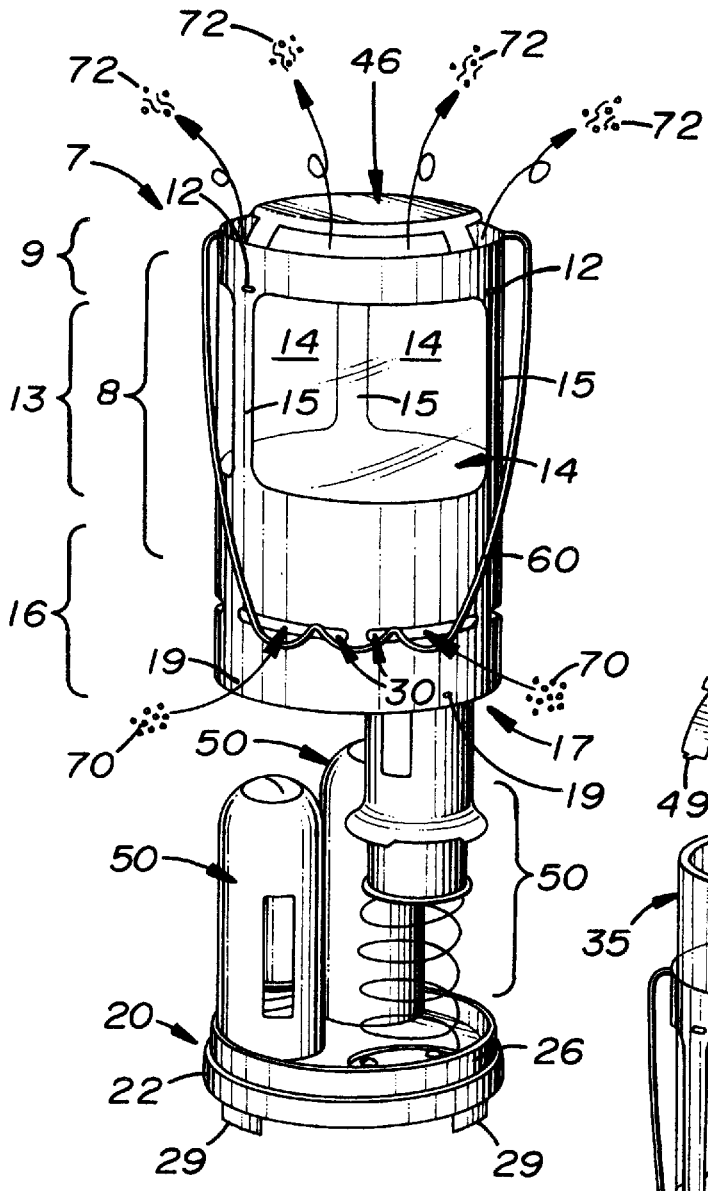
FIG. 1 is a perspective view of the candle lantern showing the upper section and outer tube partially removed.
FIG. 2 is another perspective view of candle lantern showing the heat shield and lens being removed.

Shown in the accompanying FIGS. 1–5, there is shown a portable candle lantern, generally referred to as 7 designed to be used with a plurality of tube candles 50. The candle lantern 7 includes an upper cover 8 that selectively attaches to a relatively wide, lower base 20 which securely supports the candle lantern 7 in an upright position on a support surface 90.

The upper cover 8 is cylindrical with an upper frame section 9, a middle frame section 13, and a lower frame section 16. Located on opposite ends of the upper cover 8 is a top opening 10 and a bottom opening 17. Disposed on the middle frame section 13 are three, radially aligned viewing openings 14 (two are shown) which are separated by three, longitudinally aligned support members 15. A cylindrical glass lens 35 is positioned inside the upper cover 8. Three notches 56 are formed on the sides of the upper cover 8 just below each support member 15 which resiliently traps and holds a glass lens 35 in position inside the upper cover 8.

Figure 3:
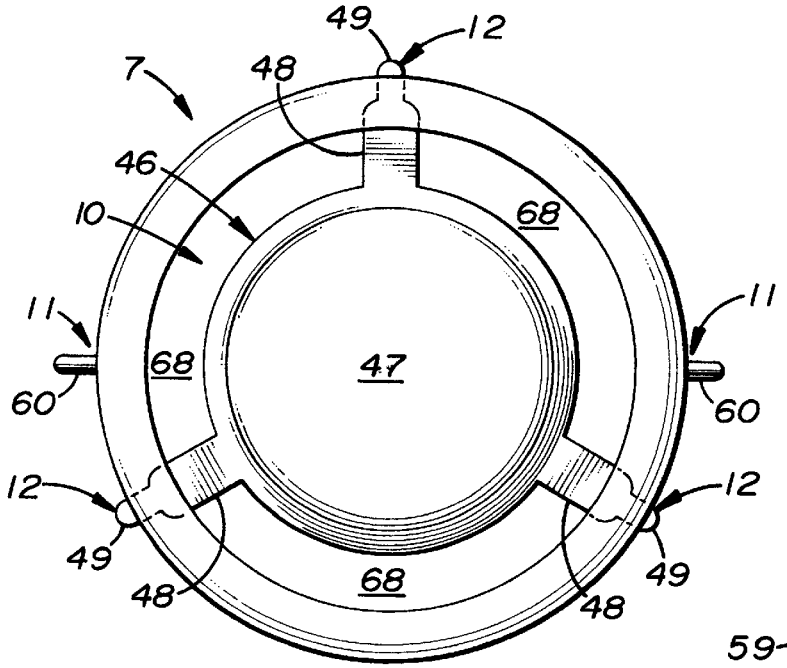
FIG. 3 is top plan view of the candle lantern shown in FIG. 1.
Figure 5:
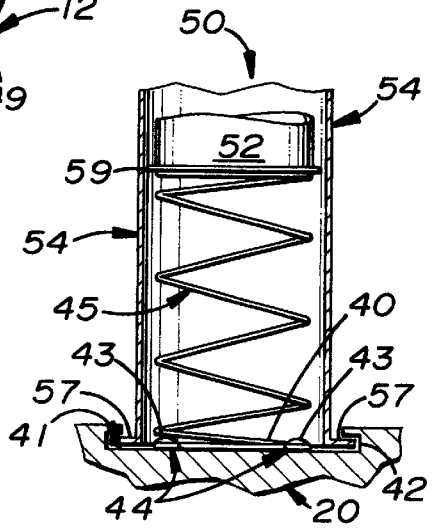
FIG. 5 is a sectional side elevational view of the lower base as taken along line 5—5 in FIG. 4.

Disposed over the top opening 10 of the upper cover 8 is a heat shield 46. As shown in FIG. 3, the heat shield 46 includes a wide central portion 47 with three outward, downward radiating, narrow side webs 48. Three exhaust openings 68 are formed between the heat shield 46 and the upper edge of the upper cover 8. The central portion 47 is flat and designed to support a small cup or the like used to heat items. The distal tips 49 of the webs 48 extend through holes 12 manufactured on the upper region of the upper cover 8 to hold the heat shield 46 in place thereon. When fully assembled, the webs 48 also prevent upward movement of the glass lens 35 in the upper cover 8. A second pair of holes 11 is formed on opposite sides of the upper frame section of the upper cover 8 through which the ends of an optional handle 60 may extend.

Figure 4:
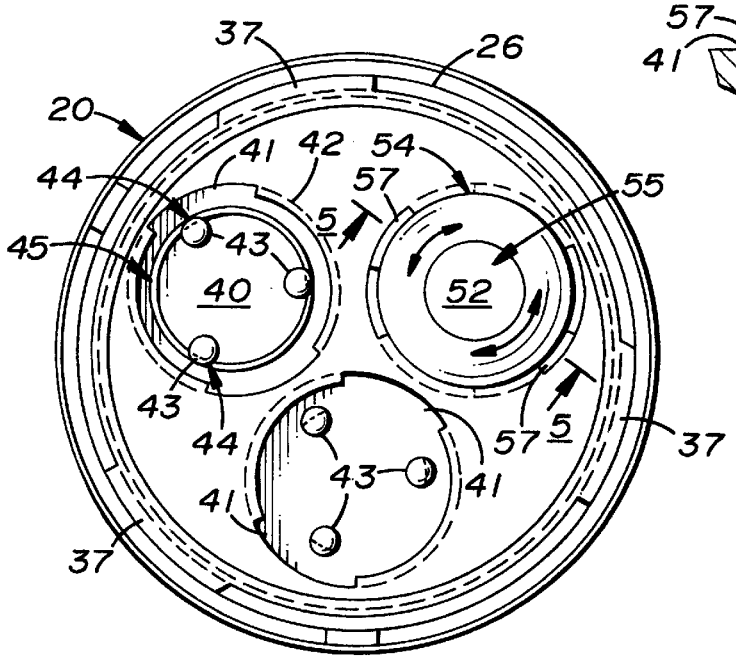
FIG. 4 is a top plan view of the lower base.

As shown in FIGS. 1 and 4, the lower base 20 is cylindrical with a lower gripping portion 22 and integrally formed, upward extending side walls 26. Formed or attached along the peripheral edge of the lower base 20 is a plurality of feet 29 which support the lower base 20 in an elevated position on a support surface 90.

Formed on the sides of the upper cover 8 near it's lower edge are air delivery slots 30. In the preferred embodiment, there are six air delivery slots 30 equally and circumferentially spaced apart around the upper cover 8. The height and length of the air delivery slots 30 may vary so that the total amount of air inlet opening is between 1.125 to 4.5 square inches. The air delivery slots 30 are designed to provide sufficient amount of air evenly around the candles to support combustion and eliminate hot or cool zones inside the candle lantern 7.

Disposed between the lower base 20 and the upper cover 8 is a cover attachment means which enables the upper cover 8 to be easily, selectively attached to the lower base 20. Also as shown in FIGS. 1 and 4, the cover attachment means includes at least one lip structure 37 formed on the outside surface of the upward extending side walls 26 on the lower base 20 and at least one detent surface 19 formed on the inside surface of the lower frame section 16 of the upper cover 8. The lip structure 37 and the detent surface 19 are radially aligned on the lower base 20 and the upper cover 8, respectively, so that when the upper cover 8 is placed over the lower base 20 and rotated, the lip structure 37 engages the detent surface 19 to selectively attach the lower base 20 to the upper cover 8. The gripping surface 22 formed on the outer surface of the lower base 20 improves handling.

Formed on the top, inside surface of the lower base 20 are three tube candle attachment means designed to hold three tube candles 50 in a perpendicularly position therefrom. In the preferred embodiment, the ends of tube candles 50 are radially and equally spaced apart on the lower base 20. Each tube candle attachment means comprises a circular, recessed space 40 in which the lower end of a tube candle 50 may be placed. On opposite sides of each recessed space 40 are two laterally extending wing-shaped recessed spaces 41 designed to receive the flange surfaces 57 formed on the tube candles 50. Slots 42 are formed on the vertical surface of the sections of the lower base 20 between the recessed spaces 41. During assembly, the slots 42 receive the flange surfaces 57 when the tube candles 50 are aligned and inserted into the recessed spaces 40 and rotated.

Each tube candle 50 comprises a cylindrical candle 52 covered by an elongated, cylindrical tube 54. A spring 45 is disposed inside each tube 54 between the top surface of recessed space 40 and a piston 59 located below each candle 52. A spring attachment means is provided on the lower base 20 which holds one end of the spring 45 thereon. In the preferred embodiment, the spring attachment means includes three, radially aligned, upward extending projections 43 with grooves 44 formed along their outer surface which, during assembly, engage the spring 45.

In the embodiment shown, the candle lantern 7 measures approximately 8 inches in height and 4 inches in diameter and uses three tube candles 50 each measuring approximately 1⅛ inches in diameter and 3½ inches in height. The upper cover 8 which is made of metal measures approximately 7¼ inches in height and 4 inches in diameter. The viewing windows 14 formed on the upper cover 8 are approximately 3¼ inches in height and 3 inches in width. When assembled, the upper opening on each tube candle 50 is positioned approximately ¾ inches above the lower edge of the viewing openings 14. The heat shield 46 is positioned approximately 3½ inches above the tube candles 50. In the preferred embodiment, the central portion 47 of the heat shield 46 is circular and measures between 1½ to 4 inches in diameter. The three exhaust openings 68 located between the central portion 47 and the upper frame section 9 are each approximately ½ inch wide and 2¾ inches in length. The lower base 20 is made of durable plastic material and measures approximately 4 inches in diameter and ¾ inches in height. The feet 29 have sufficient length to elevate the lower base 20 approximately 3⁄16 inch above a support surface 90. In the embodiment shown, the air delivery slots 30 are circumferentially aligned near the lower edge of the upper cover 8, approximately 3⁄10 inch in height, 1½ inches in length, ½ inch apart, and provide approximately 2.5 square inches of total air inlet opening.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A multiple candle lantern, comprising:

a) an upper cover, said upper cover having a lower opening, a top opening, and a plurality of viewing openings formed therein;

b) a heat-shield disposed over said top opening of said upper cover;

c) a lower base, said lower base having a longitudinal axis;

d) a plurality of air delivery slots formed on the sides of said upper cover near said lower opening, said air delivery slots capable of delivering ventilation air inside to support candle ignited inside said candle lantern;

e) a plurality of tube candles aligned parallel to each other and attached to said lower base, each said tube candle including a candle, an outer tube surround said candle and having an upper opening, and a biasing means capable of holding said candle in an upward position inside said outer tube when burning;

f) a tube candle attachment means to attach each said tube candle to said lower base;

g) a lens longitudinally disposed inside said upper cover; and, h) an upper cover attachment means enabling said upper cover to be selectively attached to said lower base.

2. A multiple candle lantern as recited in claim 1 wherein said tube candle attachment means includes a recessed space formed on a top surface of said lower base with locking means capable of securely attaching one said tube candle to said lower base.

3. A multiple candle lantern as recited in claim 2 further including three recessed spaces formed radially on said lower base with one said tube candle attached thereto.

4. A multiple candle lantern as recited in claim 3 further including said biasing means being a spring.

5. A multiple candle lantern as recited in claim 4 further including a spring attachment means on said lower base to attach said spring thereto.

6. A multiple candle lantern as recited in claim 1, wherein said upper cover attachment means includes at least one lip structure formed on said lower base and at least one detent structure formed on said upper cover, said lip structure and detent being aligned on said lower base and said upper cover so that when said lower base is placed over said lower opening on said upper cover and rotated, said detent structure engages said lip structure to selectively attach said lower base to said upper cover.

7. A multiple candle lantern as recited in claim 1, further including said heat shield having a flat central portion with three outer extending web members.

8. A multiple candle lantern as recited in claim 7, wherein said flat central section is circular with a diameter at least one and one-half inches.

9. A multiple candle lantern as recited in claim 1, further including a handle attached to said upper cover.

10. A candle lantern as recited in claim 9, wherein said cover attachment means includes at least one lip structure formed on said lower base and at least one detent structure formed on said upper cover, said lip structure and detent structure being aligned on said lower base and said upper cover, respectively, so that when said lower base is placed into said lower opening on said upper cover and rotated, said detent structure engages said lip structure to selectively attach said lower base to said upper cover.

* * * * *